United States Patent [19]

Yashiro

[11] 4,004,174

[45] Jan. 18, 1977

[54] ROTARY ANODE STRUCTURE FOR AN X-RAY TUBE

[75] Inventor: Hideo Yashiro, Tokyo, Japan

[73] Assignee: Tokyo Shibaura Electric Co., Ltd., Tokyo, Japan

[22] Filed: Nov. 1, 1974

[21] Appl. No.: 520,228

[30] Foreign Application Priority Data

Nov. 2, 1973 Japan ..... 48-122894

[52] U.S. Cl. ..... 313/330; 313/60; 313/311; 427/160

[51] Int. Cl.[2] ..... H01J 35/08

[58] Field of Search ..... 313/330, 60, 311; 427/160

[56] References Cited

UNITED STATES PATENTS

| | | | |
|---|---|---|---|
| 2,274,865 | 3/1942 | Machlett | 313/330 X |
| 2,430,800 | 11/1947 | Atlee | 313/330 X |
| 3,689,795 | 9/1972 | Benesovsky | 313/330 |
| 3,697,798 | 10/1972 | Machenschalk et al. | 313/330 |
| 3,719,854 | 3/1973 | Sedlatschek et al. | 313/330 |
| 3,778,654 | 12/1973 | Hueschen et al. | 313/330 X |

*Primary Examiner*—Saxfield Chatmon, Jr.
*Attorney, Agent, or Firm*—Cushman, Darby & Cushman

[57] ABSTRACT

An X-ray tube includes a rotary anode structure having a rotary target. The target includes an electron receiving layer made of a tungsten based alloy and a substrate made of a molybdenum based alloy containing titanium and/or zirconium in an amount of 0.5 to 2.0% by weight.

10 Claims, 3 Drawing Figures

ROTARY ANODE STRUCTURE FOR AN X-RAY TUBE

This invention relates to a rotary anode structure for an X-ray tube, and in particular to a rotary anode structure having an electron receiving surface made of tungsten or a tungsten based alloy and a substrate made of a molybdenum based alloy.

The electron receiving surface or layer of a target for an X-ray tube is desirably made of a tungsten based alloy. If, however, the target as a whole is made of such a tungsten based alloy, it becomes heavy, leading to various drawbacks. There has recently been used a composite target in which that portion, hereinafter referred to as an electron receiving layer, subjected to an electron impingement is made of a tungsten alloy and the remaining portion, i.e., a substrate is made of molybdenum having a relatively small specific gravity. However, the composite target must meet the following requirements:

a. A strong bonding can be effected between the substrate and the electron receiving layer of the target.

b. The thermal expansion coefficient of the substrate should be made to approach to that of the electron receiving layer: Suppose that the substrate and electron receiving layer of the target greatly differ in thermal expansion coefficient from each other. When the target is brought to a high temperature due to electron bombardment, distortion occurs between the substrate and the electron receiving layer due to a difference in thermal expansion coefficient. As a result, the target is deformed or the electron receiving layer comes off.

c. The substrate of the target should have a strong resistance to a thermal shock.

d. The substrate of the target should have a strength enough great not to be deformed during the rotation of the target.

e. An X-ray, which is excellent in an X-ray generating efficiency as well as in characteristics, can be emitted.

When the Mo-W composite target is considered under these requirements, it satisfies the requirements (c) to (e). In order to obtain a better target, however, the other requirements (a) and (b) should be satisfied.

It is accordingly the object of this invention to provide a rotary anode structure for X-ray tubes, including a target which has an excellent bonding strength as exhibited between a substrate and an electron receiving layer thereof, as well as has the advantages as exhibited in a conventional Mo-W composite target.

With a target of a rotary anode structure according to this invention, a substrate and an electron receiving layer can be made of those materials close in thermal expansion coefficient to each other, without losing the above-mentioned advantages of this invention.

The rotary anode structure according to this invention further includes a target supporting shaft made of the same material as that of the substrate of the target.

The target of the rotary anode structure according to this invention includes a substrate and an electron receiving layer formed on one side of the substrate. The substrate is made of a Mo based alloy formed by adding titanium and/or zirconium, in an amount of 0.5 to 2.0% by weight, to molybdenum, and the electron receiving layer is formed of tungsten or a W based alloy. The addition of titanium and/or zirconium to the molybdenum greatly enhances the recrystalization temperature of molybdenum and prominently improves a high temperature resistant characteristic. If the amount of the adding metal is below 0.5% by weight, no sufficient mechanical strength is obtained. As the amount of the adding metal is increased, the mechanical strength of the substrate is correspondingly increased. HOwever, if the amount of the adding metal 2.0% by weight, the plastic deformation capability of the Mo based alloy is markedly decreased. As a result, cracks and breakage are likely to occur during the foregoing, rolling etc. of the target. Since the target substrate of the Mo based alloy exhibits a somewhat lower thermal expansion coefficient than that of a target substrate of molybdenum along, it is possible to make the thermal expansion coefficient of the target substrate approach to that of the electron receiving layer formed of the W bassed alloy.

If tungsten is further added in small amounts to the above-mentioned Mo based alloy, the thermal expansion coefficient of the target substrate is further decreased and the mechanical strength of the target substrate is increased. In order to enhance the above-mentioned effects, the more the amount of tungsten the better. However, as the amount of tungsten is increased, the weight of the target is undesirably increased. The allowable range of tungsten as added to the Mo based alloy is in a range of below 10% by weight, preferably in a range of 3 to 8% by weight, based on the whole weight of molybdenum.

The above-mentioned Mo based alloy preferably includes silicon and potassium in small amounts in an attempt to increase the mechanical strength of the target structure. This effect is obtained, since the addition of these metals prevents coarsening of the crystal grain of the Mo based alloy. Silicon and potassium are added preferably in an amount of 0.005 to 0.015% by weight to the Mo based alloy, respectively. If the amount of these metals exceeds 0.015%, difficulty is presented in forging the Mo based alloy. In a case of below 0.005%, no sufficient result is obtained.

Where the target, shaft and fitting are made of a Mo based alloy having the above-mentioned composition, an excellent mechanical strength can be obtained.

This invention will be further described with reference to the accompanying drawing.

Figure 1:
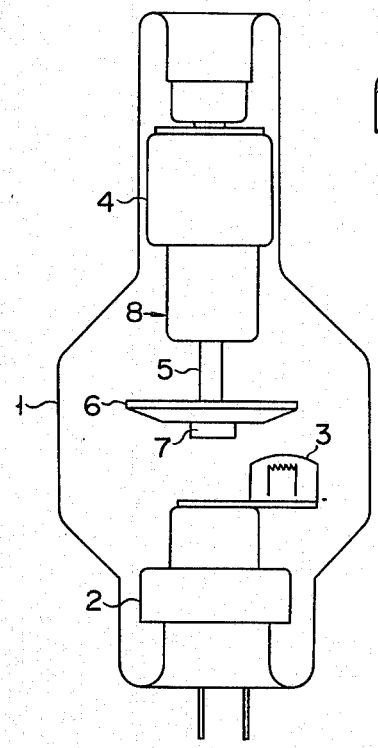
FIG. 1 is a diagrammatic view showing an X-ray tube having a rotary anode structure according to an embodiment of this invention.

In an X-ray tube shown FIG. 1 a cathode stem 2 is provided on one side of a glass envelope 1 and a filament 3 is mounted on the stem 2. On the other side of the glass envelope 1 is mounted a rotor 4 which is rotatable with its axis as a center. A shaft 5 is mounted integrally on the rotor 4 and extends toward the cathode stem. A rotary anode target or disk 6 to be later described is secured by a screw 7 to the free end of the shaft 5, thereby constituting a rotary anode structure 8. The anode target 6 is bevelled except for a central top surface portion and has a mesa-like configuration as a whole. The target 6 has a substrate or base 9 connected to the shaft 5 and an electron receiving surface or layer 10 formed over the bevelled surface of the base 9. The electron receiving surface 10 of the target 6 is disposed, at a predetermined interval, above the filament 3 located on the cathode stem 2. When the rotor 4 and thus the target 6 are rotated, electrons from the filament impinge on the surface 10 of the target 6 to cause an X-ray to be emitted radially outwardly from the surface 10 of the target 6. The X-ray tube having a rotary anode structure as mentioned above is well known in the art and further explanation is therefore omitted.

There will now be explained a material of which the rotary anode structure is made.

EXAMPLE 1

Powdered titanium hydride or powdered zirconium hydride, or both, having a particle size of below $10\mu$ was added at suitable amounts to powdered molybdenum having 0.15% by weight of oxygen adsorbed therein and bearing a particle size of about $4\mu$. Then, powdered carbon was added in a small amount to the resultant mixture for a reducing purpose. Thus, a plurality of powdered mixtures were prepared. After agitated at a ball mill for 2 to 4 hours, the powdered mixture was compressed under a pressure of 2 tons per square centimeter into a predetermined shape using a rubber press method. The component was held at vacuum for 2 hours at a temperature of 2000° to 2200° C and sintered. The sintered mass was, after forged, machined to a predetermined shape, thereby obtaining a base structure. The composition of each base structure is shown in Table 1.

Table 1

| No. | Composition (weight %) Ti | Zr | Mo | |
|---|---|---|---|---|
| 1 | 0.4 | | Bal. | control |
| 2 | 0.4 | 0.1 | Bal. | this invention |
| 3 | 0.5 | | Bal. | " |
| 4 | 1.0 | | Bal. | " |
| 5 | 0.5 | 0.5 | Bal. | " |
| 6 | 1.5 | 0.5 | Bal. | " |
| 7 | 2.0 | | Bal. | " |

On the other hand, a sintered tungsten slug obtained by a normal powder matellurgy method was forged and rolled into a disk-like shape. As a result, a disk for a focal plane which is made of tungsten and has a uniform and fine crystal structure was obtained.

Then, the bonding surfaces of the base structure and disk were, after uniformly coated with a Mo paste, thermally bonded, by a hot press method, in a predetermined carbon mold to obtain a target.

The hot press was held for 2 hours in a hydrogen atmosphere at a temperature of 1600° C and a pressure of 0.3 ton per square centimeter. During the hot press period, the target could be shaped with a high accuracy. Since the base structure and disk were pressed at a high temperature, an alloying process was developed in a neighborhood of a boundry between the base structure and the disk, thereby obtaining an excellent bonding strength.

A plurality of sample targets were prepared by varying the composition of the Mo based alloy. The sample was incorporated into a target deformation measuring device as schematically shown in cross-section in FIG. 3, and the degree of deformation of the target was measured.

Figure 3:
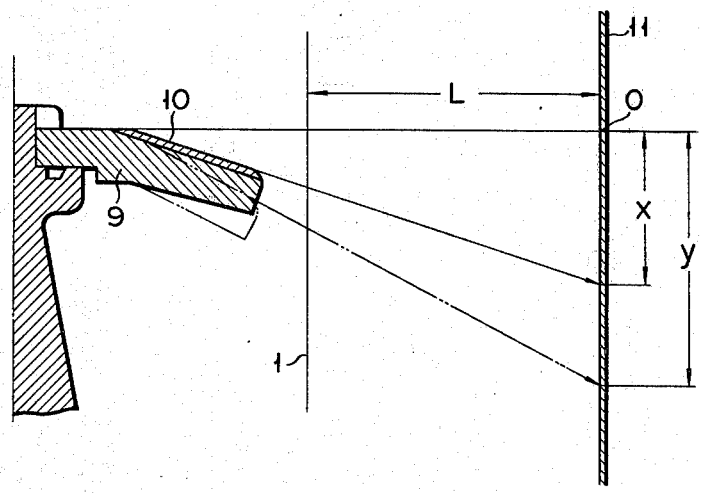
FIG. 3 is a view for explaining a method for measuring the extent to which the rotary anode structure is deformed.

The sample target was actually incorporated into an X-ray tube as cross-sectionally shown on the left side of FIG. 3. A light sensitive plate 11 was located parallel to the X-ray tube and at a predetermined distance (in FIG. 3, L) from the wall of the envelope 1. If the X-ray tube was operated, then an X-ray is emitted onto the light sensitive plate 11 and the emitting range of the X-ray is determined. If, therefore, the target is deformed during the operation of the X-ray tube, the emitting range of the X-ray so appears on the light sensitive plate 11. Now suppose that in FIG. 3 an X-ray to be emitted from the target occupies a range as indicated by dotted lines i FIG. 3 and, in this case, the X-ray emitting distance as measured from an original point 0 is $y$. Also suppose that, during the operation of the target, the target is deformed to cause the emitting range of the X-ray to be moved to a point as indicated by a solid line and, in this case, the X-ray emitting distance as measured from the original point 0 is $x$. Then, the degree of deformation of the target will be expressed as follows:

$$\text{deformation } (\%) = \frac{100(y - x)}{y}$$

The degree of deformation of each target was examined.

The test was conducted under the following conditions. The target was, while rotated, subjected to an electron impingement at a rate of four seconds per once to generate an X-ray, and an X-ray emitting range occupied at the start of the target and an X-ray emitting range occupied after 100 times electron impingements were effected were measured.

As a result, the Mo based alloy targets shown in Table 1 exhibited no deformation, except that No. 3 target showed a 3% deformation, and were operated in better conditions.

For a comparison purpose, a target consisting of a tungsten-molybdenum composite structure was tested in a like manner. The target undesirably showed a 10 to 30% deformation.

EXAMPLE 2

Ti, Zr, $SiO_2$ and $K_2O$ were added in varying ratios to Mo and base structures each made of a Mo alloy having a composition as shown in Table 2 were formed using the same method as in Example 1. A tungsten layer for a focal plane was formed, as in Example 1, on the base structure to form a target. The target was incorporated in an X-ray and long-period tests were conducted. As a result, the target showed no deformation and was operated in a good condition.

Table 2

| | Ti | Zr | Si | K | Mo |
|---|---|---|---|---|---|
| 21 | 0.5 | — | 0.008 | 0.01 | Bal. |
| 22 | 1.0 | — | 0.005 | 0.015 | Bal. |
| 23 | 0.5 | 0.5 | 0.01 | 0.01 | Bal. |
| 24 | | 1.0 | 0.01 | 0.005 | Bal. |
| 25 | — | 0.5 | 0.01 | 0.01 | Bal. |

[measuring unit: weight percent]

EXAMPLE 3

With regard to a 0.5 Ti-0.5Zr-Mo system alloy, Mo was partially replaced by W to from Mo based alloys and targets were formed using the same method as in Example 1 and the deformation of the target was measured.

As a result, even in the case of those targets having the Mo based alloys formed by combining Ti or Zr or both with 10%, preferably 2 to 8%, by weight of tungsten, no deformation was obtained and the effect of this invention was fully attained. For a comparison purpose, a target made of a Mo-6% W alloy free from Ti and/or Zr was tested. The target showed a 5–15% deformation.

Partial replacement of molybdenum by tungsten is most effective in reducing the thermal expansion coefficient of the target and improves the strength of the target.

According to this invention, therefore, the deformation of the target is substantially completely prevented by enhancing the strength of the base structure. Furthermore, it is possible to reduce the generation of a thermal stress due to a difference in the thermal expansion coefficient of the compound structure and thus it is possible to provide a target operable in a good condition without imparting any undue stress to the target.

As a material for the layer for a focal plane, use may be made of tungsten or a tungsten based alloy. In an attempt to improve the characteristic of the alloy, the other material such as an iron family metal (such as Fe, Co, Ni, etc.), a doping agent (such as Al, Si, K, etc.) and a high melting metal (such as Re, Hf, Os, Ir, etc.) may be added in small amounts to the alloy.

If the members, such as a rotary shaft and a fitting for securing the target to the shaft, which, together with the target, forms an anode structure is made of the above-mentioned Mo based alloy, an excellent mechanical strength can be imparted to the anode structure as a whole.

There will now be explained the shaft of the rotary anode structure.

EXAMPLE 4

Powdered titanium hydride or powdered zirconium hydride, or both, having a partical size of below 10$\mu$ was added in suitable amounts to powdered molybdenum having 0.15% by weight of oxygen adsorbed therein and bearing a particle size of about 4$\mu$. Then, powdered carbon was added in a small amount to the resultant mixture for a reducing purpose. Thus, a plurality of powdered mixtures were obtained. After agitated at a ball mill, the powdered mixture was compressed under a pressure of 2 tons per square contimeter into a predetermined shape using a rubber press method. The compact was held at vacuum for two hours at a temperature of 2000° to 2200° C and sintered. The sintered mass was, after thermally forged, machined to obtain a sample shaft. The composition of each sample is shown in Table 3.

Table 3

| Sample No. | Composition (weight percent) Ti | Zr | Mo | |
|---|---|---|---|---|
| 1 | 0.4 | — | Bal. | Control |
| 2 | 0.4 | 0.1 | Bal. | this invention |
| 3 | 0.5 | — | Bal. | " |
| 4 | 1.0 | — | Bal. | " |
| 5 | 0.5 | 0.5 | Bal. | " |
| 6 | 1.5 | 0.5 | Bal. | " |
| 7 | 2.0 | — | Bal. | " |
| 8 | — | — | 100 | Control |

Figure 2:
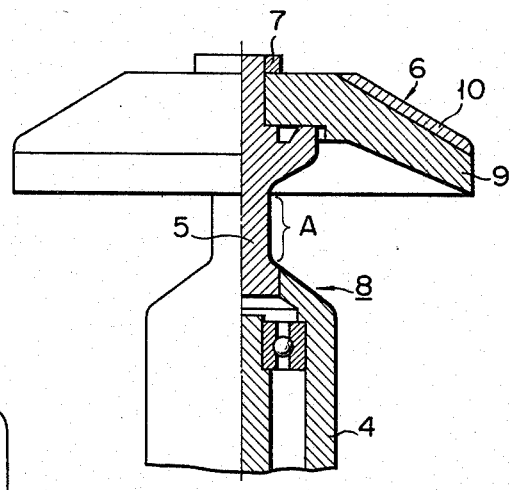
FIG. 2 is a side view, partially broken away, showing the anode structure of FIG. 1.

The sample was incorporated into the X-ray tube as shown in FIG. 1 and tested. The test was conducted under the following conditions using a target having an outer diameter of 100 mm and a weight of 650g:

1. the number of rotations: 9,000 rpm
2. a starting time required for the rotation of the shaft to be increased from 0 to 9,000 rpm: 1.5 seconds
3. a braking time required for the rotation of the shaft to be decreased from 9,000 rpm to 0: 1.8 seconds
4. a rotation duration including an electron emitting time: 4 seconds The sample was rotated 30,000 times with the rotation duration, i.e., 4 seconds as one cycle and the deformation of the sample was examined by measuring the extent to which a section A as shown in FIG. 2 was dimensionally deformed. When the section A is free at its both ends, if a plastic deformation such as torsion occurs, the shaft diameter is narrowed and elongated by that extent. The results of the test are shown in Table 4. The samples according to this invention showed almost no deformation and were operated at a good condition.

Table 4

| Sample No. | Shaft diameter (mm) before test | after test | number of deformations / number of tests |
|---|---|---|---|
| 1 | 6.01 | 5.95 | 1/10 |
| 2 | 6.00 | 6.00 | 0/10 |
| 3 | 6.01 | 6.01 | 0/10 |
| 4 | 6.02 | 6.01 | 0/10 |
| 5 | 6.00 | 6.00 | 0/10 |
| 6 | 6.02 | 6.02 | 0/10 |
| 7 | 6.02 | 6.02 | 0/10 |
| 8 | 6.02 | 5.85 | 4/10 |

EXAMPLE 5

Titanium and zirconium were added to molybdenum. Then, silicon oxide and potassium oxide were added to the resultant mixture to obtain a Mo alloy having a composition shown in Table 5. The mixture was treated in the same procedure as in Example 4 and machined into a sample shaft. Tests were conducted under the same conditions as in Example 4. As a result, the samples showed no deformation and were operated under a good condition.

Table 5

| Sample No. | Composition (weight percent) Ti | Zr | Si | K | Mo |
|---|---|---|---|---|---|
| 21 | 0.5 | — | 0.008 | 0.01 | Bal. |
| 22 | 1.0 | — | 0.005 | 0.015 | Bal. |
| 23 | 0.5 | 0.5 | 0.01 | 0.011 | Bal. |
| 24 | — | 1.0 | 0.01 | 0.005 | Bal. |
| 25 | — | 0.5 | 0.01 | 0.01 | Bal. |

EXAMPLE 6

Molybdenum of a 0.5% Ti-0.2% Zr-Mo alloy was partially replaced by tungsten to form a sample shaft. The composition of the sample is shown in Table 6. The sample was tested under the same conditions as in Example 4. As will be evident from Table 6, even if tungsten is added to the alloy, the samples show no deformation. However, when the machining of the shaft is considered together with a material cost, it is preferred that an amount of tungsten as added to the alloy be in a range of below 10%.

Table 6

| Sample No. | Composition (weight percent) Ti | Zr | W | MO |
|---|---|---|---|---|
| 31 | 0.5 | 0.2 | 2 | Bal. |
| 32 | 0.5 | 0.2 | 5 | Bal. |

Table 6-continued

| Sample No. | Composition (weight percent) Ti | Zr | W | MO |
|---|---|---|---|---|
| 33 | 0.5 | 0.2 | 8 | Bal. |

EXAMPLE 7

The shaft, fitting and target of a rotary anode structure were formed using a composition shown in Table 7 and incorporated into the X-ray tube. Tests were conducted under the similar conditions as in Example 1. The shaft, fitting and target showed no deformation.

Table 7

| Sample No. | Composition (weight percent) Ti | Zr | Mo |
|---|---|---|---|
| 41 | 0.4 | 0.1 | Bal. |
| 42 | 1.0 | — | Bal. |
| 43 | 1.5 | 0.5 | Bal. |

What is claimed is:

1. A rotary anode structure for an X-ray tube comprising a rotary target including a substrate and an electron receiving layer, said substrate being made of a Mo based alloy containing in an amount of 0.5 to 2.0% by weight a metal therefor selected from the group consisting of titanium, zirconium and a mixture thereof, said electron receiving layer being made of one selected from the group consisting of tungsten and a W based alloy in which said alloy forming the substrate further includes silicon and potassium in an amount of 0.05 to 0.015% by weight.

2. A rotary anode structure according to claim 1 in which said electron receiving layer constituting alloy includes at least one element selected from the group consisting of Co, Ni, Al, Si, K, Re, Hf, Os and Ir.

3. A rotary anode structure for an X-ray tube comprising a rotary including a substrate and an electron receiving layer, said substrate being made of a Mo based alloy containing in an amount of 0.5 to 2.0% by weight a metal therefor selected from the group consisting of titanium, zirconium and a mixture thereof, said electron receiving layer being made of one selected from the group consisting of tungsten and a W based alloy, wherein said alloy forming the substrate further includes tungsten in a maximum W to Mo weight ratio of 1:9 and wherein said alloy forming the substrate also includes silicon and potassium in an amount of 0.05 to 0.015% by weight.

4. A rotary anode structure according to claim 3 in which said electron receiving layer constituting alloy includes at least one element selected from the group consisting of Co, Ni, Al, Si, K, Re, Hf, Os and Ir.

5. A rotary anode structure for an X-ray tube comprising a rotary target having an electron receiving layer and a rotary shaft connected to the target, said shaft being made of a Mo based alloy containing in an amount of 0.5 to 2.0% by weight of a metal selected from the group consisting of titanium, zirconium and a mixture thereof, said electron receiving layer being made of one selected from the group consisting of tungsten and a W based alloy wherein said shaft constituting alloy includes silicon and potassium in an amount of 0.05 to 0.015% by weight.

6. A rotary anode structure according to claim 5 in which there is further included a member for connecting the rotary target to the shaft, said member being made of a Mo based alloy containing in an amount of 0.5 to 2.0% one selected from the group consisting of titanium, zirconium and a mixture thereof, said electron receiving layer being made of one selected from the group consisting of tungsten and a W based alloy.

7. A rotary anode structure according to claim 5, in which said electron receiving layer constituting alloy includes at least one element selected from the group consisting of Co, Ni, Al, Si, K, Re, Hf, Os and Ir.

8. A rotary anode structure for an X-ray tube comprising a rotary target having an electron receiving layer and a rotary shaft connected to the target, said shaft being made of a Mo based alloy containing in an amount of 0.5 to 2.0% by weight of a metal selected from the group consisting of titanium, zirconium and a mixture thereof, said electron receiving layer being made of one selected from the group consisting of tungsten and a W based alloy wherein said shaft constituting alloy includes tungsten in a maximum W to Mo weight ratio of 1:9 wherein said shaft constituting alloy includes silicon and potassium in an amount of 0.05 to 0.015% by weight.

9. A rotary anode structure according to claim 8 in which said electron receiving layer constituting alloy includes at least one element selected from the group consisting of Co, Ni, Si, K, Re, Hf, Os and Ir.

10. A rotary anode structure for an X-ray tube comprising a rotary target having an electron receiving layer thereon, and a rotary shaft connected thereto, said shaft being made of a Mo base alloy containing in an amount of 0.5 to 2.0% by weight of a metal selected from the group consisting of titanium, zirconium and a mixture thereof, and said target being made of the same material as said shaft, and said electron receiving layer being made of one selected from the group consisting of tungsten and a W based alloy.

* * * * *

UNITED STATES PATENT OFFICE

CERTIFICATE OF CORRECTION

Patent No. 4,004,174 Dated January 18, 1977

Inventor(s) Hideo Yashiro

It is certified that error appears in the above-identified patent and that said Letters Patent are hereby corrected as shown below:

Please amend the Foreign Application Priority Data on the face of the Grant to read:

--Japanese Application Serial Number 48-122894 filed November 2, 1973 and Japanese Application Serial Number 49-87519, filed August 1, 1974.--

Signed and Sealed this Twelfth Day of April 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 4,004,174 Dated January 18, 1977

Inventor(s) Hideo Yashiro

It is certified that error appears in the above-identified patent and that said Letters Patent are hereby corrected as shown below:

Claim 1, line 10, after "potassium" insert --each--;

line 11, delete "0.05" and insert --0.005--.

Claim 3, line 12, after "potassium" insert --each--;

line 13, delete "0.05" and insert --0.005--.

Claim 5, line 10, after "potassium" insert --each--;

line 11, delete "0.05" and insert --0.005--.

Claim 8, line 12, after "potassium" insert --each--;

line 12, delete "0.05" and insert --0.005--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*